US005548204A

United States Patent [19]

Armstrong, II et al.

[11] Patent Number: 5,548,204

[45] Date of Patent: Aug. 20, 1996

[54] LINEAR/SWITCHING REGULATOR CIRCUIT

[75] Inventors: Gene L. Armstrong, II, Garland; David L. Freeman, Plano, both of Tex.

[73] Assignee: Benchmarq Microelectronics, Dallas, Tex.

[21] Appl. No.: 323,035

[22] Filed: Oct. 14, 1994

[51] Int. Cl.[6] ..... G05F 1/575

[52] U.S. Cl. ..... 323/265; 323/273; 323/282

[58] Field of Search ..... 323/265, 273, 323/282

[56] References Cited

U.S. PATENT DOCUMENTS

| | | | |
|---|---|---|---|
| 3,585,491 | 6/1971 | Petersen . | |
| 3,691,448 | 9/1972 | Milward | 320/39 |
| 3,697,850 | 10/1972 | Heinrich et al. | 320/39 |
| 4,716,353 | 12/1987 | Engelmann | 320/21 |
| 4,725,769 | 2/1988 | Cini et al. | 323/283 |
| 4,870,555 | 9/1989 | White | 363/21 |
| 5,034,676 | 7/1991 | Kinzalow | 323/268 |
| 5,177,676 | 1/1993 | Inam et al. | 363/80 |
| 5,258,701 | 11/1993 | Pizzi et al. | 323/269 |
| 5,309,082 | 5/1994 | Payne | 323/270 |
| 5,352,970 | 10/1994 | Armstrong, II | 320/39 |
| 5,414,341 | 5/1995 | Brown | 323/268 |

FOREIGN PATENT DOCUMENTS

| | | | |
|---|---|---|---|
| 2610149 | 7/1988 | France | H02M 1/08 |

OTHER PUBLICATIONS

"High Efficiency Converters", Application Note 29, Linear Technology, pp. AN29–17–18, Sep. 1994.

*Primary Examiner*—Jeffrey L. Sterrett
*Attorney, Agent, or Firm*—Gregory M. Howison

[57] ABSTRACT

A reconfigurable integrated circuit chip includes an output terminal (42) which is connected to the output of an inverting amplifier (44). The integrated circuit chip (10) includes an output terminal (46) which is connected to one input of a comparator (22). The other end of comparator (22) is connected to an internal voltage reference device (48). The output of comparator (22) is connected to the input of the inverting amplifier (44). The integrated circuit chip (10) may be configured as a linear regulator when a transconductance device (14) is connected between a DC power supply (12) and a load and an integrator (24) is connected between terminal (42) and the control input of the transconductance device (14). The integrated circuit chip (10) is configured as a switching regulator when a gated switch (14) is connected between a DC power supply (12) and a switching node (65) wherein the gated switch (14) is gated by the signal output by the output terminal (42). The switching node (65) is connected to the cathode of a switching diode (66) and to one side of a switching inductance (68) with the other side of the switching inductance connected to the load 16. A voltage is sensed across a load resistor (18) and input into the comparator (22) which compares the sensed voltage to the reference voltage (48) and outputs the differential waveform into the output terminal (42). This then controls transistor (14) and causes it to vary the current passing through the load (16).

16 Claims, 4 Drawing Sheets

LINEAR/SWITCHING REGULATOR CIRCUIT

CROSS-REFERENCE TO RELATED APPLICATIONS

This application is related to U.S. Pat. No. 5,352,970, issued Oct. 4, 1994, which is incorporated herein by reference.

TECHNICAL FIELD OF THE INVENTION

The present invention pertains in general to reconfigurable chips and, more particularly, to a reconfigurable integrated circuit chip operable to be configured as either a linear regulator or a switching regulator.

BACKGROUND OF THE INVENTION

Power supply regulation has become much more integrated due to the number of features that are incorporated in general power management circuitry. The power management circuitry that presently is utilized allows designers to incorporate single chip devices to be manufactured that provide a wide range of versatility. When initially defining the features of an integrated circuit power management chip, the designer must consider all possible applications that can be facilitated with their part.

One feature that must be accommodated in designing any type of power management system is the type of regulation that can be accommodated. Typically, there are two types of regulation, switching regulators and linear regulators. The components required for these features are typically external components. For example, a switching regulator requires a switching transistor, a switching diode and some type of reactive component, such as an inductor. These are not adaptable to fabrication in an integrated circuit as the switching transistor requires too much power and the inductor, of course, requires very high "Q", which is not a feature that can be practically designed in an integrated circuit. However, one problem facing a designer is the fact that accommodating two different types of regulations typically requires two separate sets of interface circuits that must be disposed within the integrated circuit. Additionally, each of these features will be associated with separate I/O pins. The primary goal of a designer is to place as much of the functionality onto the integrated circuit as possible without requiring a large number of pins to interface with external components, thus minimizing the number of external components required to those that are virtually impossible to fabricate on an integrated circuit. In the past, this has been difficult when trying to accommodate different types of regulation circuits.

SUMMARY OF THE INVENTION

The present invention disclosed and claimed herein comprises a reconfigurable integrated circuit chip operable to be configured as either a linear regulator or a switching regulator. The reconfigurable integrated circuit chip comprises an output terminal and an input terminal for receiving a current sense signal indicating the level of current flow through an external load. A converter is provided for converting the current sense signal to a switched signal varying between the first and second voltage levels that varies as a function of the current level through the external load as represented by the current sense signal and the switched signal output from the output terminal. The reconfigurable integrated circuit is configured as a linear regulator when a transconductance device having an input and an output and a control input is connected between a DC supply and the load and an integrator is connected between the output terminal and the control input of the transconductance device for integrating the switching signal to provide a control current to the control input. The reconfigurable integrated circuit is configurable as a switching regulator when a gated switch is connected between the DC supply and a switching node. The gated switch is gated by the switched signal output at the output terminal. The switching node is connected to the cathode of a switching diode and the other side of the diode is connected to ground. The cathode of the switching diode is also connected to one side of a switching inductance, the other side of the switching inductance connected to the load.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
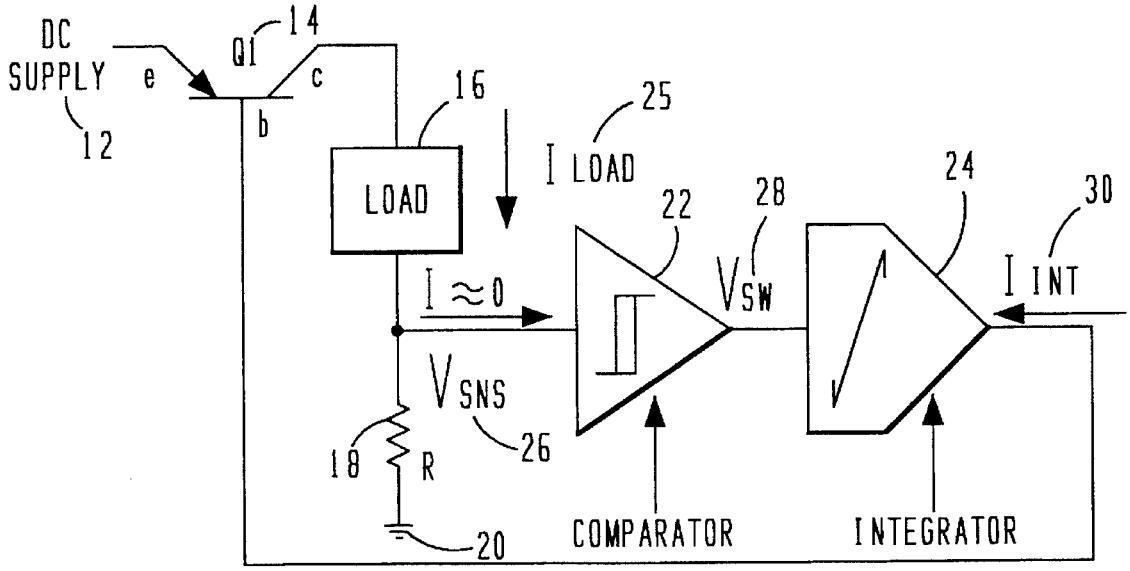
FIG. 1 illustrates a block diagram of the reconfigurable regulator.

Referring now to FIG. 1, there is illustrated a block schematic diagram of the reconfigurable integrated circuit chip system. A DC power supply 12 is provided. A PNP bi-polar switching transistor 14 is provided having a base, an emitter and a collector. The emitter of transistor 14 is connected to the power supply 12. A load 16 is provided having an input and an output. The input of the load 16 is connected to the collector of the transistor 14. A sense resistor 18 is provided with one side connected to the output of the load 16 and the other side connected to ground 20. A comparator 22 is provided with an input, an internal voltage reference and an output. The input of the comparator 22 is connected to the output of load 16. A voltage to current integrator 24 is provided having an input and an output. The input of the integrator 24 is connected to the output of the comparator 22. The output of integrator 24 is connected to the base of transistor 14.

In operation, the DC supply 12, which is unregulated, is input into the emitter of transistor 14. The current from the DC supply 12 is then passed through the collector of transistor 14 to the load 16 and is shown as $I_{LOAD}$ 25. The comparator 22 senses the voltage, $V_{SNS}$ 26 (V sense) across the resistor 18. A comparator 22 then compares $V_{SNS}$ 26 with the internal reference voltage and outputs a voltage $V_{SW}$ 28 (V switch) through the integrator 24 which integrates the voltage $V_{SW}$ 28 into a current. The integrator 24 outputs a current $I_{INT}$ 30 (I integrated) to the base of transistor 14 to turn on the transistor 14 until $V_{SNS}$ 26 reaches a predetermined upper threshold. Therefore, $I_{LOAD}$ 25 keeps building until reaching the upper threshold which then turns it off and the integrator 24 begins to integrate the current down until $V_{SNS}$ 26 reaches a lower threshold.

Figure 2:
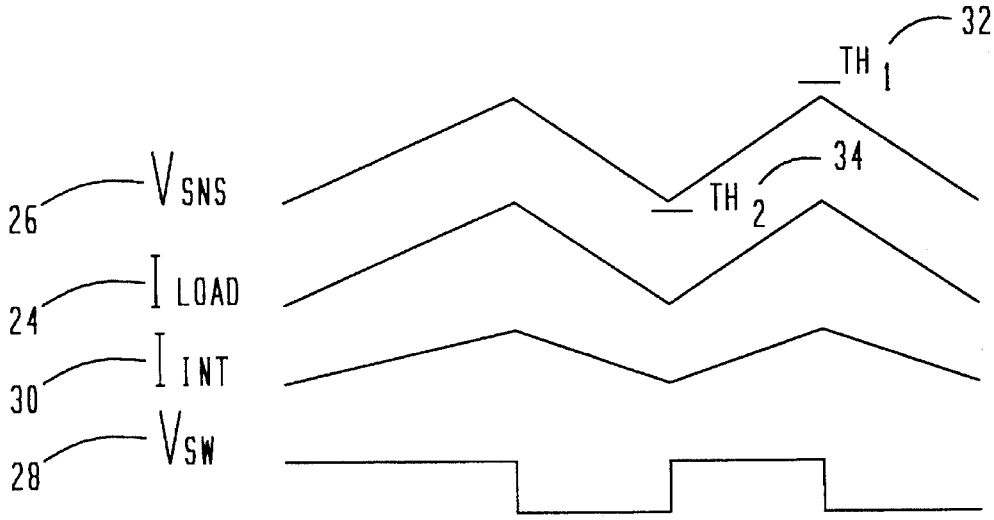
FIG. 2 illustrates a timing diagram for the reconfigurable regulator chip system.

Referring now to FIG. 2, there is illustrated a timing diagram of the system of the present invention. $V_{SNS}$ 26 (V sense) is shown ranging from $Th_1$ 32 to $Th_2$ 34. $V_{SNS}$ 26 represents the voltage across the sense resistor 18 at the output of the load 16. $I_{LOAD}$ 25, which represents the current flowing through the load 16 is shown. $I_{INT}$ 30 (I integrated) represents the integrated current at the output of the integrator 24 and is shown. $V_{SW}$ 28 (V switch) is shown and is the voltage at the output of the comparator 22.

In operation, the DC supply 12 is input into the emitter of transistor 14. The transistor 14 controls the transfer of the current from the DC supply 12 through transistor 14 from its emitter to the collector. $V_{SNS}$ 26 is sensed at the output of the load 16. If $V_{SNS}$ 26 is below the threshold $Th_1$ 32, the transistor 14 is turned on allowing current from the DC supply 12 to pass through the transistor 14 to the load 16. This causes $V_{SNS}$ 26 to rise as shown. In turn, $I_{LOAD}$ 25 also rises as shown. $V_{SNS}$ is sensed across the sense resistor 18. $V_{SNS}$ 26 is then input into the comparator 22 which compares $V_{SNS}$ 26 to an internal voltage reference. The output of the comparator, which is $V_{SW}$ 28, goes high when the transistor 14 is on and $V_{SNS}$ 26 and $I_{LOAD}$ 25 are rising. The $V_{SW}$ 28 is then input into the integrator 24 where the voltage is integrated into a current which is output as $I_{INT}$ 30. The integrator 24 integrates the input wave form which is $V_{SW}$ 28. The output of the integrator 24 $I_{INT}$ keeps rising until $V_{SNS}$ 26 reaches threshold $Th_1$ 32. When this occurs, the output of the comparator 22 which is $V_{SW}$ 28 switches to a low position, causing the output of the integrator 24, which is $I_{INT}$ 30, to begin to decline. This declining waveform from $I_{INT}$ 30 is then input into the base of transistor 14 and controls the current from the DC supply 12 passing through from the emitter of transistor 14 and into the load 16 causing $V_{SNS}$ 26 and therefore, $I_{LOAD}$ 25 to decline, until $V_{SNS}$ 26 reaches threshold $Th_2$ 34. When this occurs, $V_{SW}$ 28 is moved to the high position and $I_{INT}$ 30, the output of integrator 24, begins to rise, and $V_{SNS}$ 26 and $I_{LOAD}$ 25 rise again until they reach threshold $Th_1$ 32.

Figure 3:
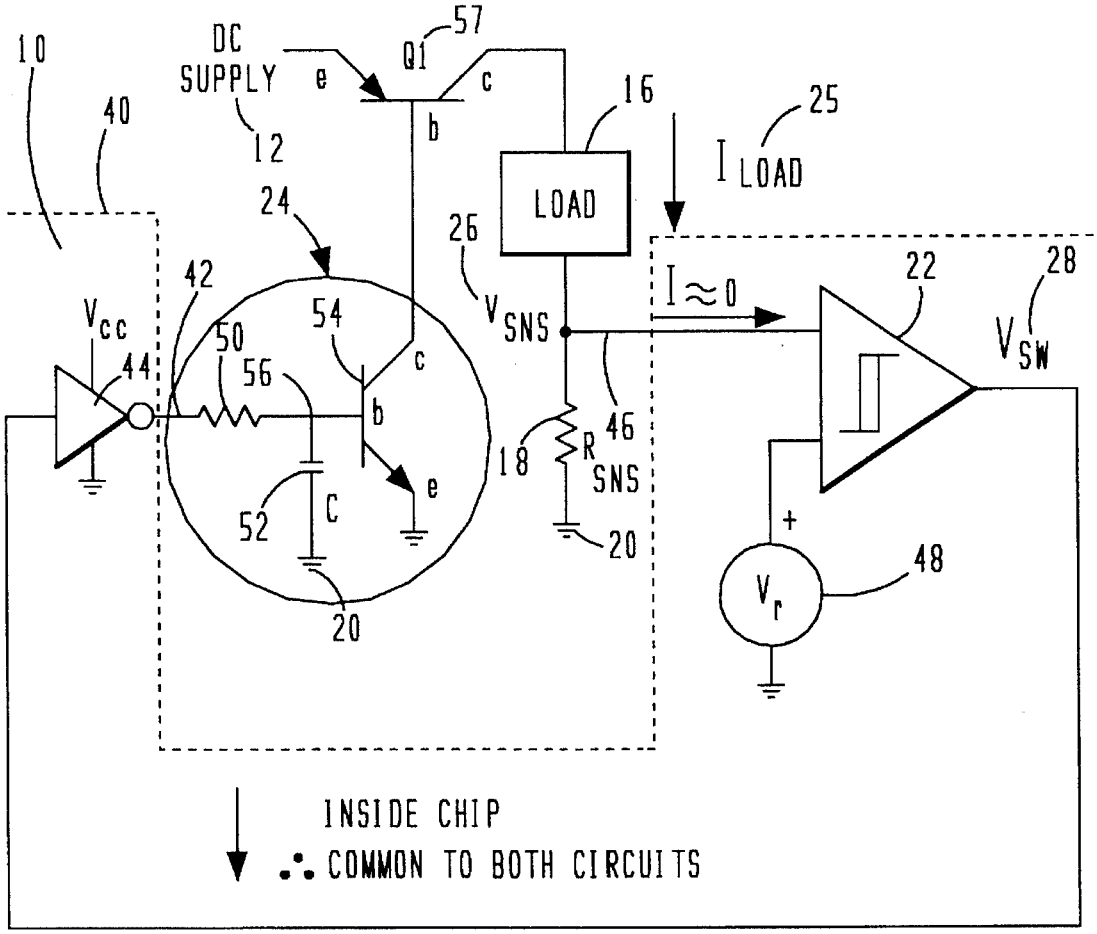
FIG. 3 illustrates a schematic diagram of the reconfigurable regulator configured as a linear regulator.

Referring now to FIG. 3, there is illustrated a schematic diagram of the linear regulator realization of reconfigurable integrated circuit chip. The integrated circuit chip 10 is shown separated from the external components by line 40. The integrated circuit chip 10 has an output pin 42. The output pin 42 is connected to an inverting amplifier 44 located internal to the integrated circuit chip 10. The inverting amplifier 44 has a $V_{cc}$ input, a ground connection and a general input. The output of the inverting amplifier 44 is connected to the output pin 42 of the integrated circuit chip. An input pin 46 is provided on the integrated circuit chip 10. A comparator 22 is provided having an output and two inputs. An internal voltage reference device 48 is provided having an offset voltage of 250 millivolts. The positive output of the voltage reference device 48 is connected to one input of the comparator 22. The other input of the comparator 22 is connected to the input pin 46 of integrated circuit chip 10. The output of comparator 22 is connected to the input of the inverting amplifier 44.

An external integrator 24 is shown comprising a resistor 50 with one side of resistor 50 connected to the output pin 42 of the integrated circuit chip 10. The integrator 24 also consists of a capacitor 52 with one side thereof connected to ground 20 and the other side of capacitor 52 connected to the remaining side of resistor 50 at a node 56. The integrator 24 also consists of an NPN bi-polar transistor 54 having a collector, an emitter and base. The base of transistor 54 is connected to node 56. The emitter of transistor 54 is connected to ground 20. A DC power supply 12 is provided external to the integrated circuit chip 10. A PNP bi-polar transistor 57 is also provided external to the integrator circuit chip 10. The transistor 57 has a base, an emitter and a collector. The emitter of transistor 57 is connected to the power supply 12. The base of transistor 57 is connected to the collector of transistor 54. The input of load 16 is connected to the collector of transistor 14. The output of load 16 is connected across the sense resistor 18 to ground 20. The output of load 16 is also connected to the input pin 46 of the integrated circuit chip 10.

In operation, the DC supply 12 is input into the emitter of transistor 57. The transistor 57 controls the transfer of the current from the DC supply through transistor 57 from its emitter to the collector and then to the load 16 by controlling the transconductance therethrough, this as function of the base current. $V_{SNS}$ 26 is sensed at the output of the load 16. If $V_{SNS}$ 26 is less than the threshold $Th_1$ 32, the transistor 57 is turned on allowing current from the DC supply 12 to pass through the transistor 57. This causes $V_{SNS}$ 26 to rise. In turn, $I_{LOAD}$ 25 also rises. $V_{SNS}$ 26 is sensed across the sense resistor 18. $V_{SNS}$ 26 is then input into the comparator 22 which compares $V_{SNS}$ 26 to the internal voltage reference 48. The output of the comparator 22, which is $V_{SW}$ 28, goes high when the transistor 14 is on and $V_{SNS}$ 26 and $I_{LOAD}$ 25 are rising. The $V_{SW}$ 28 is then input into the inverting amplifier 44. The output signal of the inverting amplifier 44 is fed across a resistor 50 into the base of the NPN transistor 54. The capacitor 52 is connected between the base of transistor 54 and ground 20. When $V_{SW}$ 28 goes low, the voltage in the capacitor 52 rises and when $V_{SW}$ 28 goes high, the voltage in capacitor 52 decays this controlling the current through transistor 54 and the base current of transistor 57. The transconductance of transistor 57 then either increases or decreases depending on the base current thereof and this controls the current from the DC supply 12 passing through from the emitter of transistor 57 to the load 16. Thus the voltage $V_{SW}$ 28 is integrated into a base central current for transistor 57, causing $V_{SNS}$ 26, and therefore $I_{LOAD}$ 25, to adjust accordingly. When this occurs, $V_{SNS}$ 26 and $I_{LOAD}$ 25 rise or fall until they reach threshold $Th_1$ 32 or $Th_2$ 34.

Figure 3A:
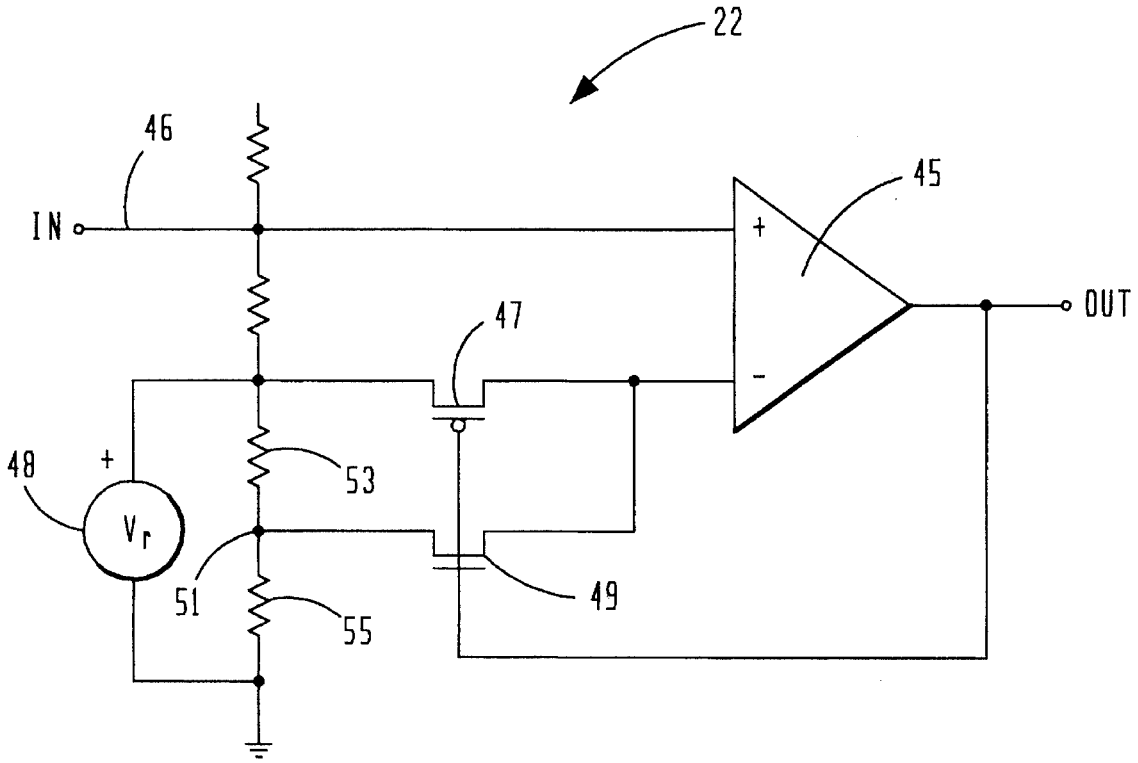
FIG. 3*a* illustrates a schematic diagram of the comparator.

Referring now to FIG. 3*a*, there is illustrated a detail of the comparator 22. In general, the comparator is comprised of a comparator 45, having a positive input and a negative input, the positive input connected to the input 46. The negative input of comparator 45 is connected to one side of the source/drain path of a P-channel transistor 47, the other side of the source/drain path thereof connected to the positive side of the reference voltage 48. The gate of transistor 47 is connected to the output of the comparator 45. The negative input of comparator 45 is also connected to one side of the source/drain path of an N-channel transistor 49, the other side of the source/drain path of the N-channel transistor connected to a node 51. The gate of transistor 49 is connected to the output of the comparator 45. A first resistor 53 is connected between the positive output of reference voltage generator 48 and the node 51 and a second resistor 55 is connected between the node 51 and ground, the negative side of the reference voltage generator 48 connected to ground also. Therefore, resistors 53 and 55 provide a resistive divider. In operation, transistors 47 and 49 select either the full voltage of the reference voltage generator 48 or the divided voltage at node 51. This, of course, is a function of the output voltage of the comparator 45.

Figure 4:
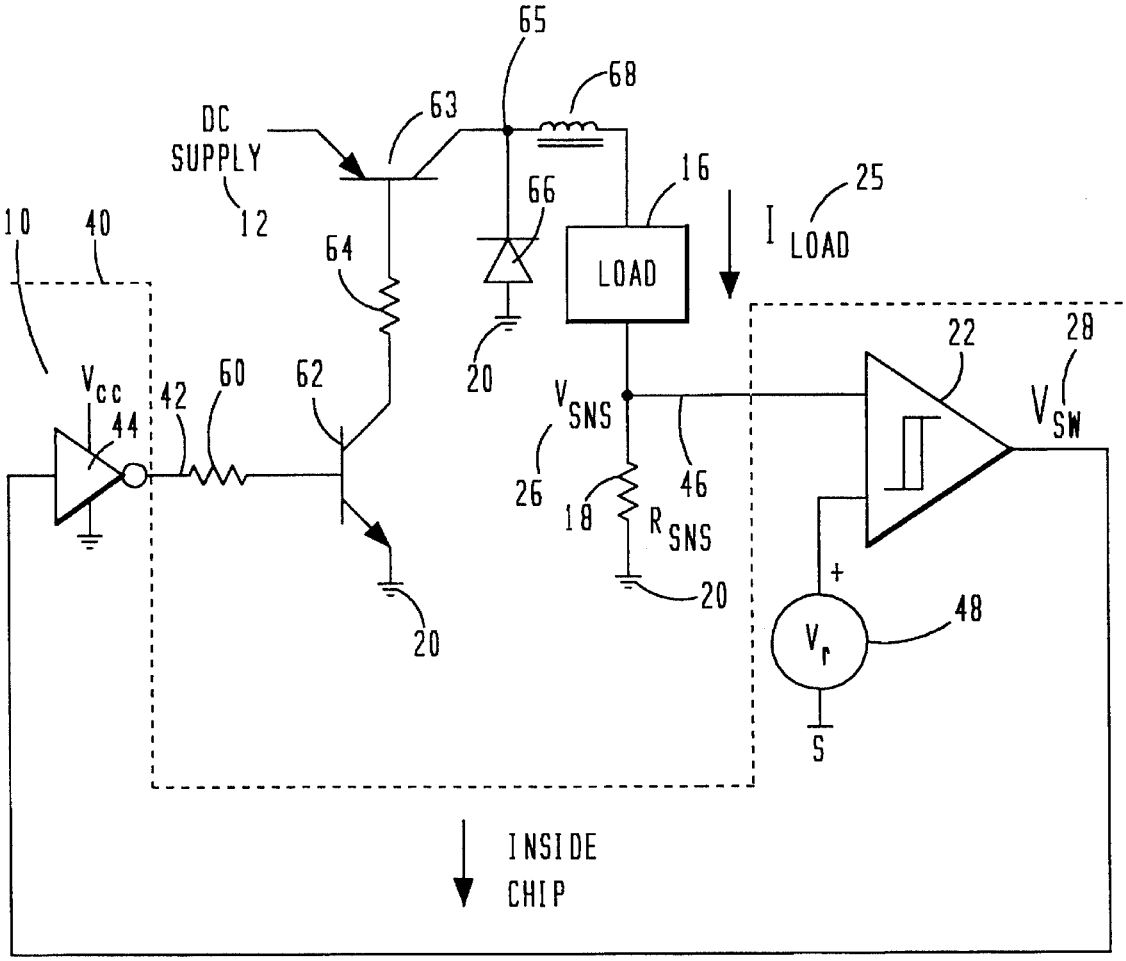
FIG. 4 illustrates a schematic diagram of the reconfigurable regulator configured as a switching regulator.

Referring now to FIG. 4, there is illustrated a schematic diagram of the switching realization of the reconfigurable integrated circuit. A PNP bi-polar switching transistor 63 is also provided external to the integrator circuit chip 10. The emitter of transistor 63 is connected to the power supply 12. The input of load 16 is connected to the collector of transistor 63.

A resistor 60 is provided and is connected on one side thereof to the output pin 42. An NPN transistor 62 has the emitter thereof connected to ground 20 and the base thereof connected to the other side of resistor 60. A resistor 64 is provided with one side thereof connected to the base of transistor 63 and the other side thereof connected to the collector of transistor 62. The collector of transistor 63 is connected to a node 65. A diode 66 has the cathode thereof connected to node 65 and the anode of diode 66 connected to ground 20. A switching inductance 68 is provided with one side thereof connected to node 65 and the other side thereof connected to load 16.

In operation, the DC supply 12 is connected to the emitter of transistor 14. The transistor 63 controls the transfer of the current from the DC supply through transistor 63 from its emitter to the collector in a switching manner. $V_{SNS}$ 26 is sensed at the output of the load 16. If $V_{SNS}$ 26 is less than the threshold $Th_1$ 32, the transistor 63 is turned on allowing current from the DC supply 12 to pass through the transistor 63. This causes $V_{SNS}$ 26 to rise. In turn, $I_{LOAD}$ 25 also rises. The comparator 22 then compares $V_{SNS}$ 26 to the internal voltage reference 48. The output of transistor 22, which is $V_{SW}$ 28, goes high when the transistor 63 is on and $V_{SNS}$ 26 goes above The 34. The $V_{SW}$ 28 is then input into the inverting amplifier 44. The output of the inverting amplifier 44 is applied to one side of the resistor 60 to drive the base of the NPN transistor 62. Transistor 63 then either begins to turn on when transistor 62 is turned on or off when transistor 62 is turned off depending on whether the input is high or low, respectfully, and this controls the current from the DC supply 12 passing through transistor 14 to switching node 65.

The switching diode 66 is connected between the switching node 65 and ground 20. When transistor 63 turns on, the current in the inductor 68 rises and when the transistor 63 turns off, the current in inductor 68 decays. Thus the voltage is integrated into current and input into the load 16 causing $V_{SNS}$ 26 and therefore, $I_{LOAD}$ 25 to adjust accordingly. When this occurs, the output of inductor 68 begins to rise or fall, and $V_{SNS}$ 26 to rise or fall, until it reaches threshold $Th_1$ 32 or $Th_2$ 34.

It can be seen that with the use of a single comparator and a single input pin to the comparator, with the internal reference voltage, that a digital switching voltage $V_{SW}$ is provided and this is utilized for both a linear regulator and a switching regulator. In the linear regulator configuration, this must be converted to a linear current with the use of the integrator formed with the transistor 54, resistor 50 and capacitor 52. As such, there is a digital switching signal having two logic states, a high logic state or a low logic state that are converted by the integrator to a current. This provides a fairly stable mode of operation. Additionally, the same comparator 22 and internal regulator 48 are utilized for the switching regulator operation.

In summary, there has been provided a reconfigurable integrated circuit chip operable to be configured as either a linear regulator or a switching regulator. The reconfigurable integrated chip comprises an output terminal and an input terminal for receiving a current signal indicating the level of current flow through an external load. A converter is provided for converting the current signal to a switched signal varying between the first and second voltage levels that varies as a function of the current level through the external load as represented by the current signal and the switched signal output from the output terminal. The reconfigurable integrated circuit is configured as a linear regulator when a transconductance device having an input and an output and a control input is connected between a DC supply and the load and an integrator is connected between the output terminal and the control input of the transconductance device for integrating the switching signal to provide a control voltage to the control input. The reconfigurable integrated circuit is configurable as a switching regulator when a gated switch is connected between the DC supply and a switching node. The gated switch is gated by the switched signal output at the output terminal, the switching node is connected to the cathode of a switching diode and the other side of the diode is connected to ground. The switching diode is also connected to one side of a switching inductance, the other side of the switching inductance is connected to the load.

Although the preferred embodiment has been described in detail, it should be understood that various changes, substitutions and alterations can be made therein without departing from the spirit and scope of the invention as defined by the appended claims.

What is claimed is:

1. A reconfigurable integrated circuit chip operable to be configured as either a linear regulator or a switching regulator, comprising:

an output terminal;

an input terminal for receiving a current sense signal indicating the level of current flow through an external load;

a converter for converting said current sense signal to a switched signal varying between first and second voltage levels at a repetitive rate that varies as a function of the current level through said external load as represented by said current sense signal, said switched signal output from said output terminal;

the reconfigurable integrated circuit chip configured as the linear regulator wherein a transconductance device having an input and an output and a control input connected between a DC supply and said external load and an integrator connected between said output terminal and said control input of said transconductance device for integrating said switched signal to provide a control current to said control input, the value of which controls the transconductance of said transconductance device; and the reconfigurable integrated circuit chip configurable as the switching regulator wherein a gated switch is connected between said DC supply and a switching node, said gated switch gated by said switched signal output by said output terminal, said switched node connected to the cathode of a switching diode, the other side thereof connected to ground, and to one side of a switching inductance, the other side of said switching inductance connected to said load.

2. The reconfigurable integrated circuit chip of claim 1, wherein said input terminal is connected to one end of an external current sense resistor, which is connected in series with the load, the voltage across said resistor comprising said current sense signal.

3. The reconfigurable integrated circuit chip of claim 2, wherein said converter comprises an internal differential comparator with hysteresis having two inputs and one output, one input is connected to said input terminal and the other input is connected to an internal reference voltage, the output is connected to said output terminal.

4. The reconfigurable integrated circuit chip of claim 1, wherein said gated switch comprises a transistor.

5. The reconfigurable integrated circuit chip of claim 1, wherein said transconductance device comprises a transistor.

6. The reconfigurable integrated circuit chip of claim 1 wherein said current sense signal comprises a pulse train.

7. The reconfigurable integrated circuit chip of claim 1 wherein said integrator, when the reconfigurable integrated circuit chip is configured as the linear regulator, comprises:

a transistor having a collector, base and an emitter with the base of said transistor connected to a first node and the collector of said transistor being the output;

a capacitor having one side connected to ground and the other connected to said first node; and a resistor with one side of the resistor being the input of the integrator and the other side of the resistor being connected to said first node.

8. An integrated circuit chip operable to be configured as a linear regulator, comprising:

an output terminal;

an input terminal for receiving a current sense signal indicating the level of current flow through an external load;

a converter for converting said current sense signal to a switched signal varying between first and second voltage levels at a repetitive rate that varies as a function of the current level through said external load as represented by said current sense signal, said switched signal output from said output terminal;

a transconductance device having an input and an output and a control input for receiving a control current input and connected between a DC power supply and said load; and an integrator connected between said output terminal and said control input of said transconductance device for integrating said switched signal to provide a control current to said control input.

9. A method for configuring an integrated circuit chip operable to be operated as either a linear regulator or a switching regulator, comprising:

receiving a current sense signal indicating the level of current flow through an external load at an input terminal;

converting the current sense signal to a switched signal varying between first and second voltage levels at a repetitive rate that varies as a function of the current level through the external load as represented by the current sense signal, the switched signal output from an output terminal;

the reconfigurable integrated circuit chip configured as the linear regulator wherein a transconductance device having an input and an output and a control input connected between a DC supply and the external load and an integrator connected between the output terminal and the control input of the transconductance device for integrating the switched signal to provide a control current to the control input, the value of which controls the transconductance of said transconductance device; and the reconfigurable integrated circuit chip configurable as the switching regulator wherein a gated switch is connected between the DC supply and a switching node, the gated switch gated by the switched signal output by the output terminal, the switched node connected to the cathode of a switching diode, the other side thereof connected to ground, and to one side of a switching inductance, the other side of the switching inductance connected to the load.

10. The method of claim 9, wherein the step of receiving comprises connecting the input terminal to one end of an external current sense resistor, which is connected in series with the load, the voltage across the resistor comprising the current sense signal.

11. The method of claim 10, wherein the step of converting comprises comparing two inputs with one input connected to the input terminal and the other input connected to an internal reference voltage, the output connected to the output terminal.

12. The method of claim 9, wherein the gated switch comprises a transistor.

13. The method of claim 9, wherein the transconductance device comprises a transistor.

14. The method of claim 9, wherein the current sense signal comprises a pulse train.

15. The method of claim 9, wherein the integrator, when the reconfigurable integrated circuit chip is configured as the linear regulator, comprises:

a transistor having a collector, a base and an emitter with the transistor connected to a first node and the collector of the transistor being the output;

a capacitor having one side connected to ground and the other connected to the first node; and a resistor with one side of the resistor being the input of the integrator and the other side of the resistor being connected to the first node.

16. A method for configuring an integrated circuit chip operable to be operated as either a linear regulator or a switching regulator, comprising:

receiving a current sense signal indicating the level of current flow through an external load at an input terminal;

converting the current sense signal to a switched signal varying between first and second voltage levels at a repetitive rate that varies as a function of the current level through the external load as represented by the current sense signal, the switched signal output from the output terminal;

controlling the movement of current between a DC power supply and the load using a transconductance device having an input and output and a control input for receiving a control current input; and integrating the switched signal to provide a control current to the control input using a transconductance device connected between the output terminal and the control input.

* * * * *

UNITED STATES PATENT AND TRADEMARK OFFICE

CERTIFICATE OF CORRECTION

PATENT NO. : 5,548,204

DATED : August 20, 1996

INVENTOR(S) : Armstrong, et al.

It is certified that error appears in the above-indentified patent and that said Letters Patent is hereby corrected as shown below:

Column 5, line 29, replace "The", first occurrence, with --$Th_2$--.

Signed and Sealed this

Twenty-second Day of April, 1997

Bruce Lehman

*Attest:*

BRUCE LEHMAN

*Commissioner of Patents and Trademarks*

*Attesting Officer*